US009663318B1

(12) United States Patent
Connors

(10) Patent No.: US 9,663,318 B1
(45) Date of Patent: May 30, 2017

(54) NOISE DAMPENED MEDIA RE-DRIVE ASSEMBLY FOR AN IMAGING DEVICE

(71) Applicant: LEXMARK INTERNATIONAL, INC., Lexington, KY (US)

(72) Inventor: William Michael Connors, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/165,024

(22) Filed: May 26, 2016

(51) Int. Cl.
*B65H 29/58* (2006.01)
*B65H 85/00* (2006.01)

(52) U.S. Cl.
CPC ..... *B65H 29/58* (2013.01); *B65H 85/00* (2013.01); *B65H 2301/333* (2013.01); *B65H 2301/448* (2013.01); *B65H 2403/5331* (2013.01); *B65H 2515/82* (2013.01); *B65H 2601/521* (2013.01)

(58) Field of Classification Search
CPC .. B65H 85/00; B65H 29/58; B65H 2601/521; B65H 2301/333; B65H 2515/82; B65H 2301/448; B65H 2403/533; B65H 2403/5331; B65H 2403/5332; B65H 2403/5333
See application file for complete search history.

(56) References Cited

U.S. PATENT DOCUMENTS

| | | | | |
|---|---|---|---|---|
| 7,887,054 | B2 * | 2/2011 | Daigo | B65H 29/58 271/291 |
| 7,950,653 | B2 * | 5/2011 | Berendes | B65H 29/60 271/225 |
| 8,011,659 | B2 * | 9/2011 | Tabata | G03G 15/5029 271/185 |
| 8,628,081 | B2 * | 1/2014 | Michels | B65H 29/58 198/624 |
| 2012/0193412 | A1 * | 8/2012 | Chen | B65H 29/12 235/379 |
| 2015/0344255 | A1 * | 12/2015 | Moon | B65H 29/58 271/9.13 |

* cited by examiner

*Primary Examiner* — Patrick Cicchino
(74) *Attorney, Agent, or Firm* — John Victor Pezdek

(57) ABSTRACT

A noise dampened re-drive assembly for an imaging device. The re-drive assembly includes a two position, pivotally mounted diverter gate that is driven by a reversible motor coupled to a sector gear fixedly mounted to the diverter gate. A slot is provided in the sector gear with a stop pin positioned in the slot. An end of the slot strikes the stop pin as the diverter gate reaches one of its positions. A cantilevered mounted T-shaped dampener having a dampening finger at each of its free ends is mounts in the slot. As the end of the slot nears the stop pin when the diverter gate approaches one of its two positions, the dampening finger adjacent thereto engages the stop pin and reduces the acoustical impulse of the slot end striking the stop pin. A pair of dampeners mounted in a mirror image fashion may be provided in the slot.

18 Claims, 10 Drawing Sheets

NOISE DAMPENED MEDIA RE-DRIVE ASSEMBLY FOR AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present application relates generally to an imaging device and more particularly to a noise dampened re-drive assembly including a diverter gate for directing media between simplex and duplex portions of a media path.

2. Description of the Related Art

Most imaging or printing systems offer an automatic duplex function which reverses a media sheet to allow print or scanning of the reverse side of the media sheet. To accomplish this function most of these mechanisms have some type of a re-drive assembly which takes a media sheet that has been printed or scanned on one side and diverts it through a duplex media path back into the simplex media path such that the back side of the media sheet can then be printed or scanned. At the heart of the re-drive assembly is a diverter gate. This diverter gate directs media sheet along designated simplex or duplex portions of the media path depending on what additional operations need to be performed. An embodiment of a prior art re-drive assembly is described in U.S. Pat. No. 7,431,293, entitled "Dual Path Roll For An Image Forming Device," issued Oct. 7, 2008 and assigned to the assignee of the present disclosure. On some imaging systems, the diverter gate may be passive—actuated by the media—as illustrated in U.S. Pat. No. 8,887,564, entitled "Media Actuated Media Diverter For An Imaging Device," filed Dec. 31, 2012 and assigned to the assignee of the present disclosure. But on more complex imaging systems, the diverter gates are either driven by a solenoid or a small electric drive motor coupled to a sector gear. Typically, the diverter gate needs to be fast acting to keep up with ever increasing throughput demands where media feed rates are 40-70 media sheets per minute. The rapid actuation of the diverter gate between the simplex media path and the duplex media path and then back requires that the drive motor be driven at a high speed until the diverter gate hits a mechanical stop creating an acoustical impulse each time the diverter gate position changes. This creates high noise levels that can be distracting. While foam pads have been placed on these points of contact, the noise levels are still considered problematic. Slowing the diverter gate transition speed reduces media throughput.

It would therefore be advantageous to be able to dampen the acoustic impulses created when the diverter gate strikes the mechanical stop without reducing media throughput.

SUMMARY

Disclosed is a re-drive assembly for a media sheet in a media path of an imaging device where the media path has a simplex path and a duplex path. The re-drive assembly is positioned between an exit of the simplex path and an entrance of the duplex path and an exit of the imaging device. The re-drive assembly comprises a frame having a left and a right side positioned on opposite sides of the media path, a two-position diverter gate pivotally mounted to the left and right sides of the frame, a reversible drive motor mounted to the frame and a drive train. The drive train includes a helical drive gear mounted on an output shaft of the drive motor and a sector gear.

The sector gear has a first end fixedly mounted to an end of the diverter gate and a second end coupled to the drive gear. The sector gear, when driven by the drive motor, rotates the diverter gate between its two positions. The sector gear has a slot therein positioned between the first and second ends of the sector gear. The slot has a first and a second opposed inner side wall and opposed ends. A first and a second T-shaped dampener depend from the first and second inner side walls, respectively, forming a channel therebetween. A free end of each dampener is positioned adjacent to a respective opposed end of the slot and each free end has a flexible dampening finger extending into the channel. The second dampener is mounted in a mirror image fashion with respect to the first dampener. A stop pin mounted to the frame and in the channel. The stop pin has an unthreaded portion within the channel. As the diverter gate is rotated between its two positions and as one end of the slot nears the stop pin, the stop pin engages with the dampening fingers on the respective free ends of the first and the second dampeners prior to an end of the slot striking the stop pin which dampens the acoustical impulse of the slot end striking the stop pin.

BRIEF DESCRIPTION OF THE DRAWINGS

The above-mentioned and other features and advantages of the various embodiments, and the manner of attaining them, will become more apparent and will be better understood by reference to the accompanying drawings.

FIG. 2A shows a diverter gate of the re-drive assembly positioned to feed a media sheet to the output area of the imaging device and FIG. 2B shows the diverter gate positioned to feed a media sheet to a duplex feed path of the imaging device.

DETAILED DESCRIPTION

Figure 1:
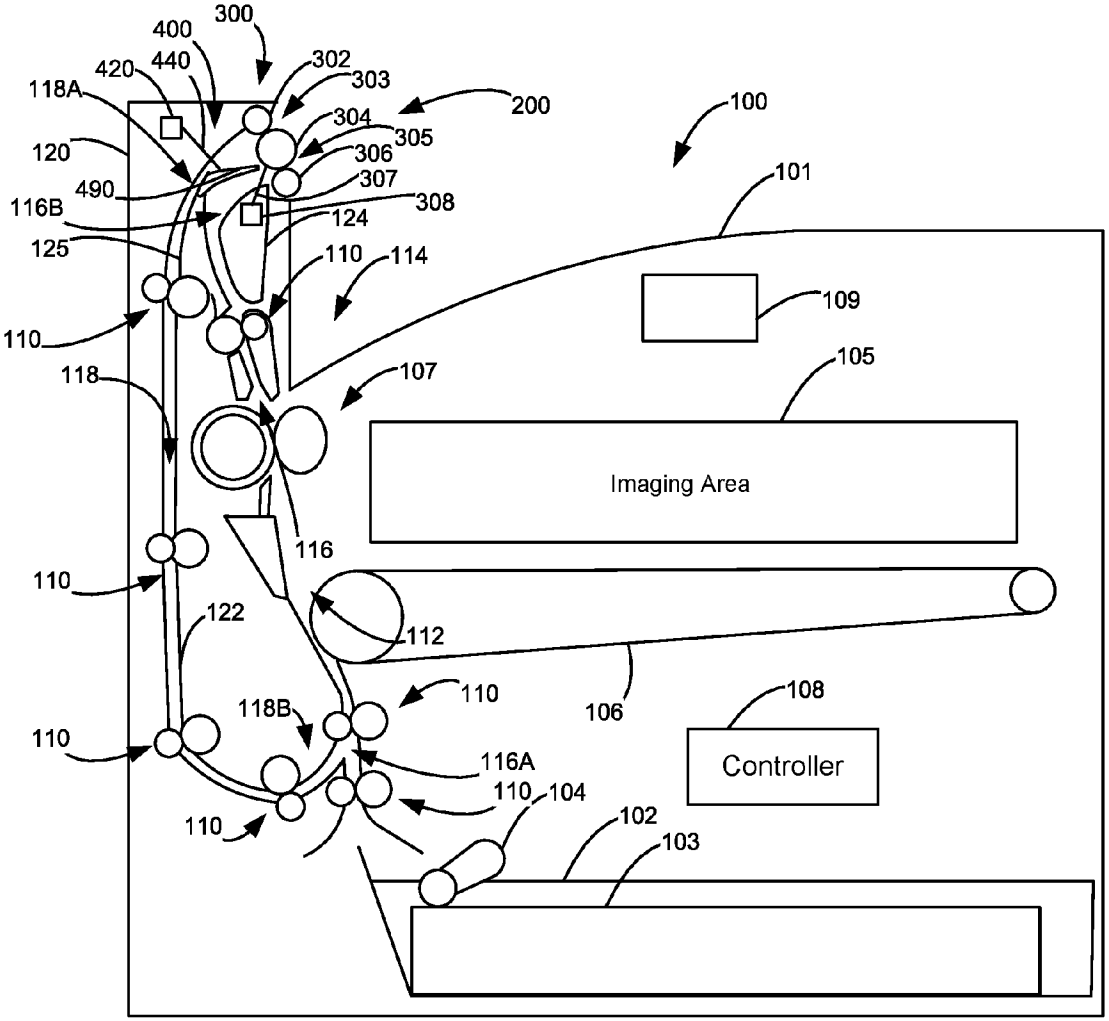
FIG. 1 schematically shows an imaging device using an embodiment of a noise dampened re-drive assembly of the present disclosure.

The following description and drawings illustrate embodiments sufficiently to enable those skilled in the art to practice it. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1 illustrates one embodiment of imaging device 100, which as illustrated is an electrophotographic printer. Imaging device 100 has a housing 101 containing a media input tray 102 having a media stack 103 having sheets of media to be transported through imaging device 100 and a media output area 114. A media path 112 extends through the imaging device 100 for moving the media sheets from the media input tray 102 through an imaging area 105 where an image is transferred to the media sheet and then to an output area 114. A feed mechanism 104 is used to feed a media sheet from the media stack 103 into a simplex path 116 forming part of a media path 112 where it is transported by a plurality of feed roll pairs 110 positioned along the media path 112.

The media path 112 includes a simplex path 116 and a duplex path 118 formed between one or more guide members 120, 122, 124, 125 within imaging device 100. Guide member 125 is positioned between the simplex path 116 and duplex path 118. An entrance 116A to the simplex path 116 is adjacent to media input tray 102. The exit 116B of simplex path 116 and the entrance 118A to duplex path 118 are on opposite sides of guide member 125. Guide members 120, 122, 124 125 may have a plurality of parallel ribs (not shown) projecting into the media path 112 to guide the media sheet M as it moves along the media path 112. Guide member 120 may be formed in a cover of imaging device 100. Guide members 120, 122, 124, 125 may be rotatable or moveable to allow for access into the media path 112 to clear media sheets that have jammed.

Imaging area 105 creates and transfers a toner image onto a transfer belt 106 as is known in the art. The toned image is transferred to one side of a media sheet being transported along the simplex path 116. The media sheet is conveyed to a fuser 107 where the toned image is bonded to the media sheet and then on to a re-drive assembly 200 at which it either exits into output area 114 or is redirected into the duplex path 118 in a peek-a-boo duplexing operation for having another image transferred to the back side of the media sheet. The media sheet is moved along the media path 112 by one or more pairs of transport rolls 110 one of which is a driven roll and one of which is an idler roll, as is known in the art.

The re-drive assembly 200 is mounted in housing 101 adjacent to the entrance 118A of duplex path 118 and the exit 116B of simplex path 116. The re-drive assembly 200 includes an exit roll assembly 300 and diverter gate assembly 400. Exit roll assembly 300, as shown, has three stacked rolls—a top or first roll 302, a middle or second roll 304, and a bottom or third roll 306. Top and middle rolls 302, 304 form a first or upper exit nip 303 and middle and bottom rolls 304, 306 form a second or lower exit nip 305. Second roll 304 may be driven by a reversible motor 308 via a gear train 307 so that the rotation direction of first exit nip 303 may be reversed when duplexing is needed. A common drive gear train may also be used for driving the rotation of the first, second and third rolls 302, 304, 306 of the re-drive assembly 200. When used, the common drive gear train has a one-way clutch coupled to the third roll 306 for limiting the drive of the third roll 306 to one direction.

With the stacked arrangement of three rolls, first and second exit nips 303, 305 will rotate in opposite directions. In the example embodiment illustrated, the first exit nip 303 is used when duplexing is needed for a media sheet and the second exit nip 305 is used when the media sheet has finished being processed and is being sent to output area 114. Alternative embodiments include those wherein this configuration is reversed such that the first exit nip 303 is the bottom nip and the second exit nip 305 is the top nip. As is convention, transport rolls 110, and first, second, and third rolls 302, 304, 306 are shown as overlapping to indicate an interference fit as is known in the art.

Rolls 302, 304, 306 may have a plurality of spaced wheels or rollers as is known in the art. The spacing between adjacent wheels is relatively narrow such that the outer surface of the first roll 302 overlaps with the outer surface of the second roll 304 which overlaps with the outer surface of the third roll 306. The overlaps between adjacent rolls form corrugated nips. When a media sheet passes through a corrugated nip, a corrugation in the form of an alternating bend is introduced across a width and length of the media sheet. The corrugation is temporary and occurs only when the media sheet is in the nip. The corrugation aids in preventing the media sheet from collapsing under its own weight as it is cantilevered outward from the first or second exit nip 303, 305. Where one media sheet is extended from the first exit nip 303 during a peek-a-boo duplex operation and another media sheet is exiting from the second exit nip 305 simultaneously, corrugation of the first exit nip 303 helps prevent the duplexing media sheet from folding down into contact with and disrupting the media sheet exiting the second exit nip 305. Corrugation of the second exit nip 305 helps prevent the media sheet exiting the second exit nip 305 from interfering with media sheets in the output area 114 as the media sheet is advanced outward by the second exit nip 305.

Diverter gate assembly 400 includes a reversible drive motor 420 coupled via gear train 440 to diverter gate 490. Diverter gate 490 pivots about pivot axis 491 that is positioned approximately in the middle of the diverter gate 490 (see FIGS. 2A-2B) and is rotated by drive motor 420 and gear train 440 between the first position for directing a media sheet exiting the simplex media path 116 at exit 116B into first nip 303 (FIG. 2B) and a second position for directing a media sheet into the second nip 305 (FIG. 2A). Diverter gate 490 forms portions of the simplex path 116 and duplex path 118 and directs the media sheet into the proper media path. A bottom surface 490-1 of diverter gate 490 forms a portion of simplex path 116 when diverter gate 490 is in its second position and an upper surface 490-2 of diverter gate 490 forms a portion of the duplex path 118 when the diverter gate 490 is in its first position. Diverter gate 490 is shown in FIG. 1 in its second position to direct a media sheet to the second or lower nip 305.

A controller 108 is in operative communication, as is known in the art, to feed mechanism 104, imaging area 105, transfer belt 106, fuser 107, a user control panel 109, the motor (not shown) for driving feed roll pairs 110, drive motors 308, 420 and controls their respective operations. Controller 108 may include a microcontroller with associated memory. In one embodiment, controller 108 includes a processor, random access memory, read only memory, and an input/output interface.

Figure 2B:
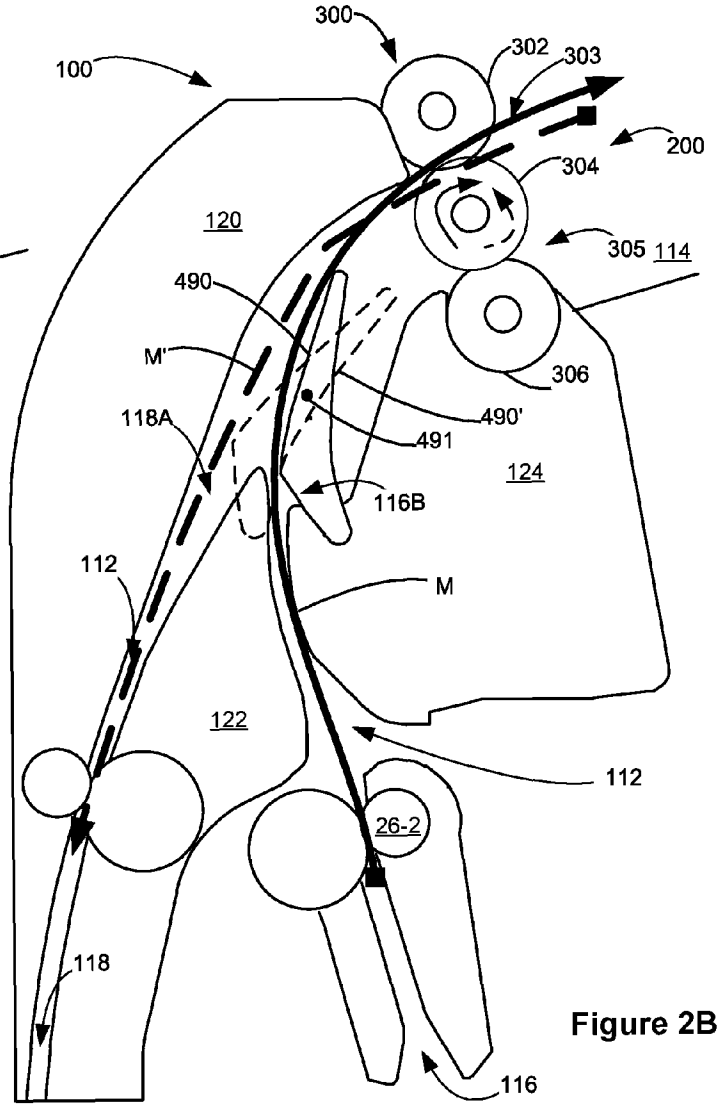
FIGS. 2A-2B schematically show the positions of the re-drive assembly where
Figure 2A:
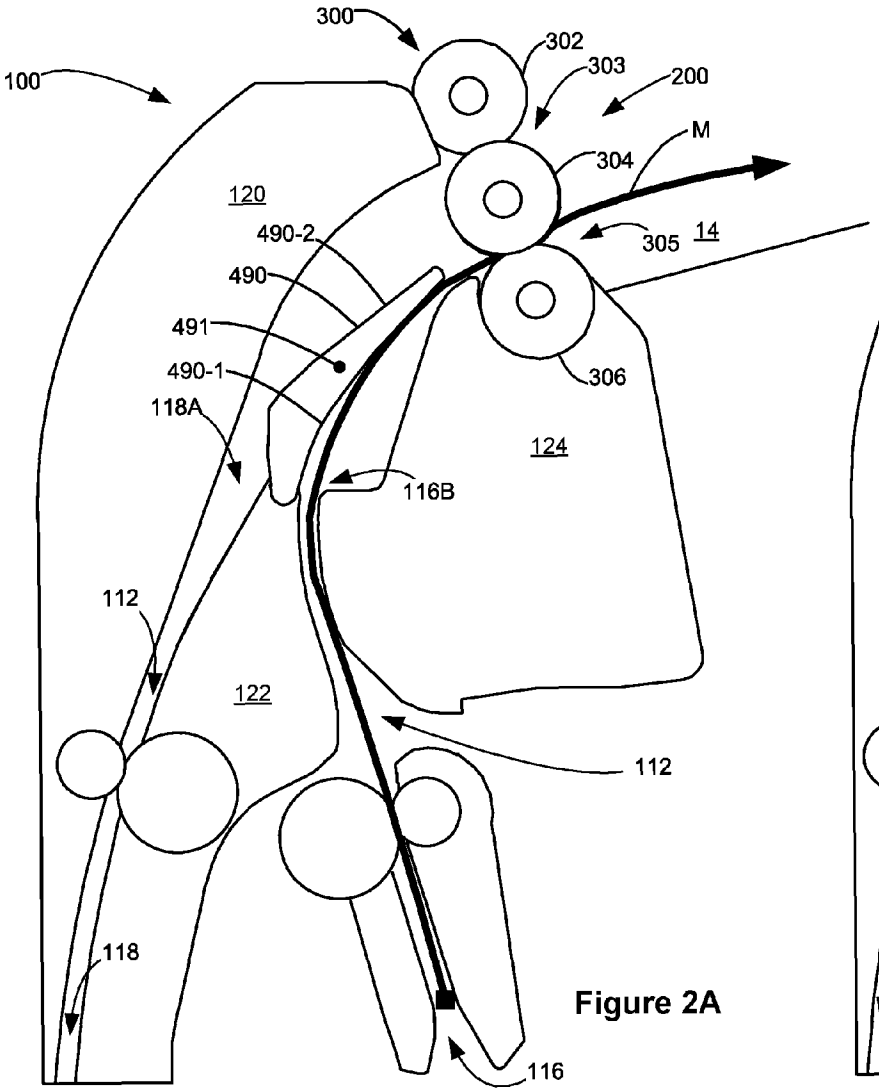

FIGS. 2A-2B illustrate a partial view of the media path 112 of the imaging device 100 adjacent the media path exit adjacent to the media output area 114. FIG. 2A illustrates a simplex operation on a media sheet M while FIG. 2B illustrates the peek-a-boo duplexing operation on a media sheet M. In FIGS. 2A-2B, the leading and trailing edges of the media sheets are shown as a solid black arrowhead and a black block, respectively.

After passing through an image transfer section, such as imaging area 105 and fuser 107, in which the media may be scanned or printed as is known in the art, the media sheet M is advanced to the re-drive assembly 200 by a feed roll pair 110. Second roll 304 may be driven by reversible motor 308 via gear train 307 so that the rotational direction of first nip 303 may be reversed as indicated by the two arrows shown in FIG. 2B. The solid arrow indicates the rotational direction when a media sheet is being sent to first exit nip 303 and the dashed line arrow indicates the rotational direction when a media sheet is being sent to the second exit nip 305.

Diverter gate 490 is pivotally mounted in diverter gate assembly 400 that is mounted in imaging device 100 between exit 116B of the simplex path 116, the entrance 118A of the duplex path 118, and the first and second exit nips 303, 305 of exit roll assembly 300. As shown in FIG. 2A, when imaging or scanning of the reverse side of the media sheet is not desired or has already occurred, diverter gate 490 is positioned to direct the media sheet M toward the second exit nip 305 for exiting into the output area 114 while simultaneously blocking the media path extending to the first exit nip 303. The curved bottom and top surfaces 490-1, 490-2 of diverter gate 490 help to direct media sheet M toward the second and first exit nips 305, 303, respectively.

Where imaging or scanning of a reverse side of the media sheet M is desired, the diverter gate 490 is driven by drive motor 420 and gear train 440 counter-clockwise as illustrated in FIGS. 1 and 2B closing off the portion of the media path 112 leading to second exit nip 305. Media sheet M is driven into the portion of the media path 112 leading to the first exit nip 303 for performing a peek-a-boo duplex operation. The media sheet M is partially exited into the output area 114 by the first exit nip 303 until a trailing edge of the media sheet M clears the diverter gate 490. The rotation of the second roll 304 is then reversed to have the media sheet M, now designated M' and shown as a dashed line, enter into the entrance 118A to the duplex path 118. What was the trailing edge of sheet M is now the leading edge of sheet M' which is then advanced through the duplex path 118 by a series of transport rolls 110, until it reaches the exit 118B of the duplex path 118 where it is reintroduced into the entrance 116A of simplex path 116 for image transfer or scanning of the reverse side of the media sheet M'. The media sheet M' is then advanced toward the diverter gate 490 which has been rotated clockwise by motor 420 and gear train 440 to its second position as indicated by the dashed line diverter gate 490' to close off the media path to first exit nip 303 and to direct the media sheet M' toward the second exit nip 305 which outputs the duplexed media sheet into the output area 114. Because the second roll 304 at the second exit nip 305 rotates outward as the first roll 302 at the first exit nip 303 rotates inward, the imaging device 100 is able to simultaneously output a finished media sheet from the second exit nip 305 and perform a peek-a-boo duplex operation using the first exit nip 303.

Figure 3:
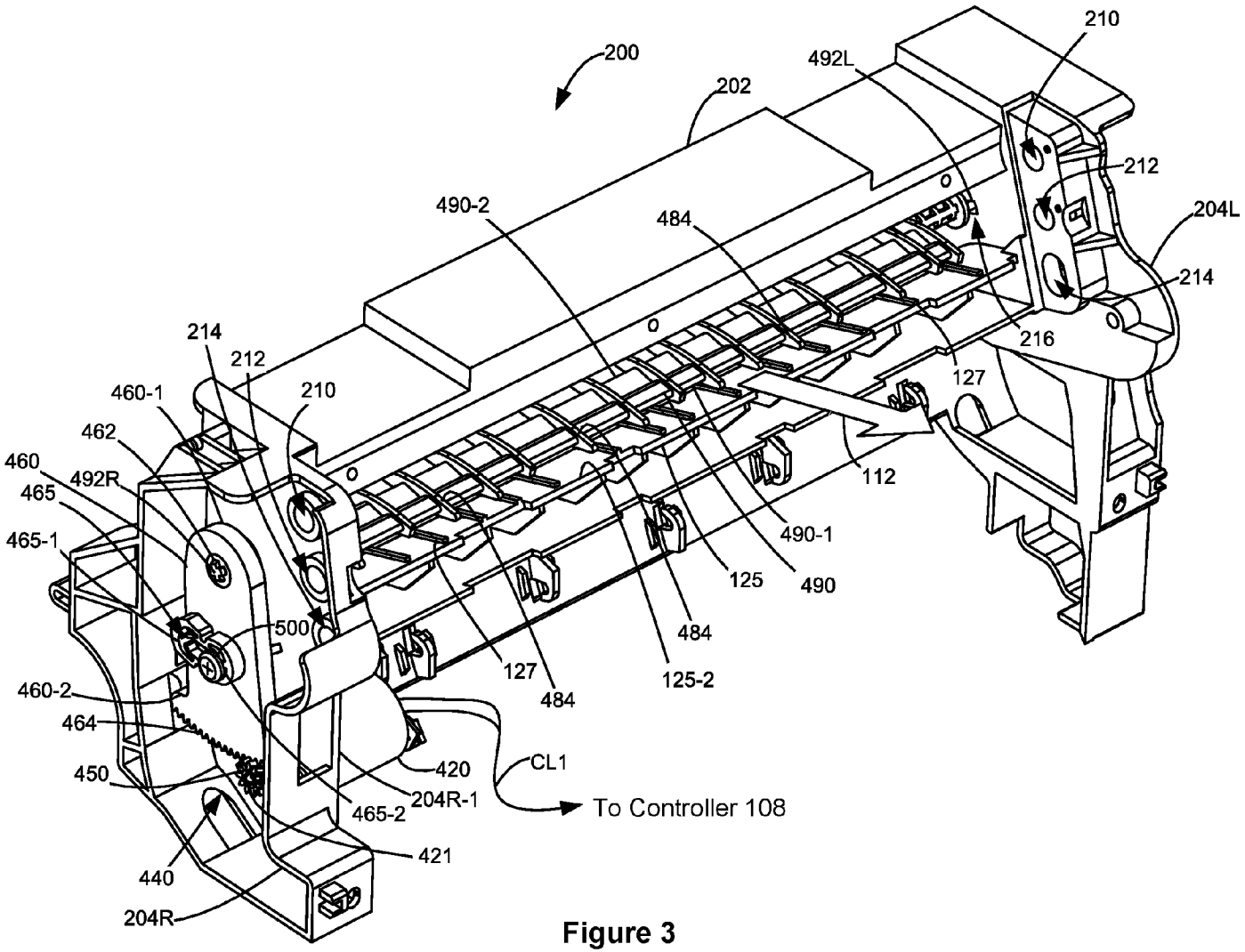
FIG. 3 is a perspective view of the noise dampened re-drive assembly of the present disclosure.
Figure 4:
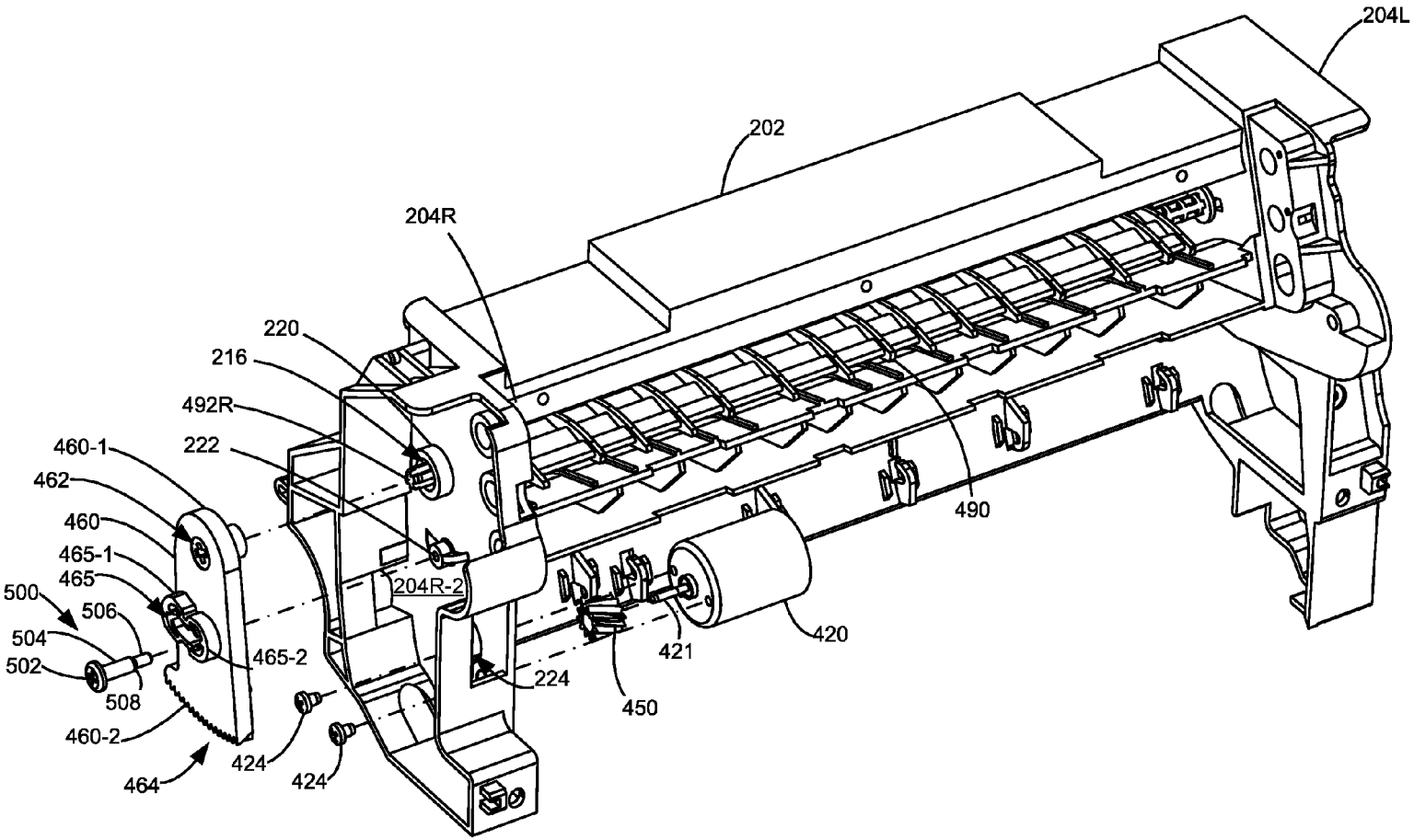
FIG. 4 is a partially exploded view of the re-drive assembly of FIG. 3.

FIGS. 3-4 illustrate the re-drive assembly 200 of the present disclosure. The roll assembly 300, having rolls 302, 304, 306, has been removed. Re-drive assembly 200 has a frame 202 having left and right sides 204L, 204R which are positioned transverse to the media path 112. Left and right is viewed with respect to a media sheet moving to the media output area 114 which in FIG. 3 would be out the plane of the page as indicated by the media path arrow 112. Mounting holes are provided in the left and right sides 204L, 204R for rolls 302, 304, 306. As shown, three pairs of aligned holes 210, 212, 214 are provided for the mounting of rolls 302, 304, 306, respectively. An additional pair of aligned holes 216 is provided inboard of hole pairs 210, 212, 214 and receive the left and right ends 492L, 492R of diverter gate 490 allowing for the pivotable mounting of diverter gate 490 to the left and right sides 204L, 204R. Left and right ends 492L, 492R act as the pivot axis 491 for diverter gate 490. The right end 492L of diverter gate 490 extends through right side 204R and has a cruciform shape and is connected to gear train 440. A cylindrical boss 220 may be provided around opening 216 in right side 204R. A second mounting boss 222 may be provided on the outer surface 204R-2 below boss 220.

A plurality of parallel ribs 484 are provided on the bottom and top surfaces 490-1, 490-2 of diverter gate 490 over its length. Media guide 125 is mounted between left and right sides 204L, 204R below diverter gate 490. Media guide 125 and frame 202 may be molded as a unitary piece. Again, a plurality of parallel ribs 127 are provided on the top surface 125-2 of media guide 125. The pluralities of ribs 484, 127 provide support for the media sheet as it travels through re-drive assembly 200.

Figure 5A:
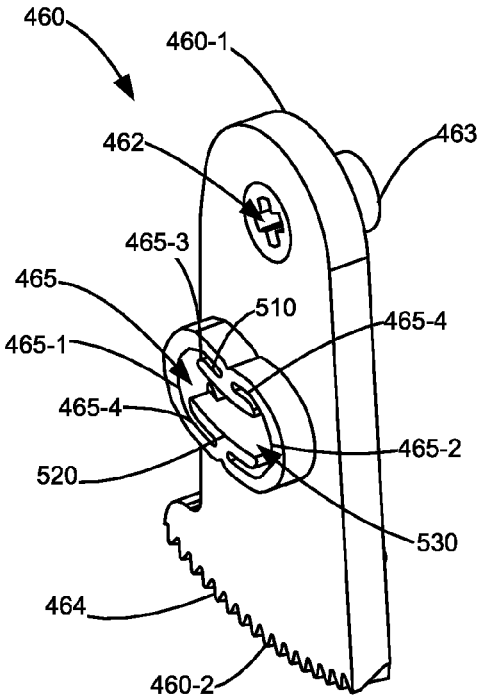
FIGS. 5A-5B illustrate the front and rear of an example noise dampening sector gear used in the re-drive assembly of FIG. 3.
Figure 5B:
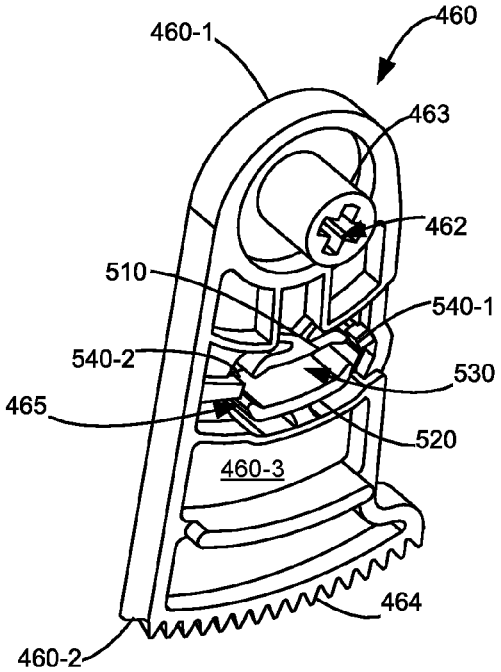

Drive motor 420 is mounted to an inner surface 204R-1 of right side 204R with screws 424. Drive motor 420 is in operative communication with controller 108 as indicated by communication link CL1. Gear train 440 is connected between output shaft 421 of drive motor 420 and the right end 492R of diverter gate 490. Gear train 440 consists of a drive gear 450 coupled to a sector gear 460. As shown, drive gear 450 is a helical gear. Drive gear 450 is mounted on the output shaft 421 of motor 420 and extends through a corresponding opening 224 in right side 204R and extends beyond the outer surface 204R-2. Sector gear 460 is mounted to the right end 492R of diverter gate 490. A cruciform opening 462 is formed in a cylindrical boss 463 on inner surface 460-3 of sector gear 460 (see FIG. 5B). Opening 462 is provided adjacent a first (upper) end 460-1 of sector gear 460 and is sized to receive the cruciform right end 492R of diverter gate 490 allowing sector gear 460 to be fixedly mounted to diverter gate 490. Second (bottom) end 460-2 of sector gear 460 has a plurality of gear teeth 464 that enmesh with drive gear 450.

Provided on sector gear 460 is a slot 465 aligned with mounting boss 222. Slot 465 is generally horizontal, has first and second opposed ends 465-1, 465-2 and first and second opposed inner side walls 465-3, 465-4 that have a slight curve to match the slight rotational arc through which diverter gate 490 travels. The rotational arc of diverter gate 490 and sector gear 460 is indicated by the angle A1 (see FIG. 6). In one example form angle A1 is approximately 40 degrees in length. A stop pin 500 is mounted through slot 465 into mounting boss 222. Stop pin 500 has a head portion 502 mounted on one end of a middle unthreaded portion 504 that has a threaded portion 506 mounted on the other end. Unthreaded portion 504 has a larger diameter than threaded portion 506 forming a shoulder 508 that seats against mounting boss 222 when stop pin 500 is installed on right side 204R. The first and second ends 465-1, 465-2 of slot 465 alternately strike the unthreaded portion 504 of stop pin 500 as the diverter gate 490 is alternately rotated between its first and second positions.

Referring now to FIGS. 5A-7, noise dampening features of sector gear 460 will be described. Depending from the opposed inner side walls 465-3, 465-4 of slot 465 are two opposed noise dampeners 510, 520, respectively. Dampeners 510, 520 are arranged in a mirror image fashion with respect to one another and form a channel 530 therebetween. Stop pin 500 is positioned within channel 530 when mounted on right side 204R of frame 202. Channel 530 has a predetermined width W1 that is larger than the diameter of unthreaded portion 504 of stop pin 500. For example, unthreaded portion 504 may have a diameter of about 4 mm while width W1 may be about 6 mm.

Dampener 510 is shown as a unitary structure having a center mount on inner side wall 465-3 and two free ends. Dampener 510 may also be viewed as having two cantilevered members 510-1, 510-2 having a common center mount 510-3 to inner side wall 465-3 and opposed free outer ends 510-4, 510-5 adjacent to slot ends 465-1, 465-2, respectively. Mounted on free outer ends 510-4, 510-5 are flexible dampening fingers 510-6, 510-7, respectively, that inwardly depend into channel 530. Dampener 520 is substantially similar to dampener 510 having two cantilevered members 520-1, 520-2 having a common center mount 520-3 to inner side wall 465-4 and opposed outer free ends 520-4, 520-5 adjacent slots ends 465-1, 465-2, respectively. Mounted on free outer ends 520-4, 520-5 are flexible dampening fingers 520-6, 520-7, respectively, that inwardly depend into channel 530.

Figure 6:
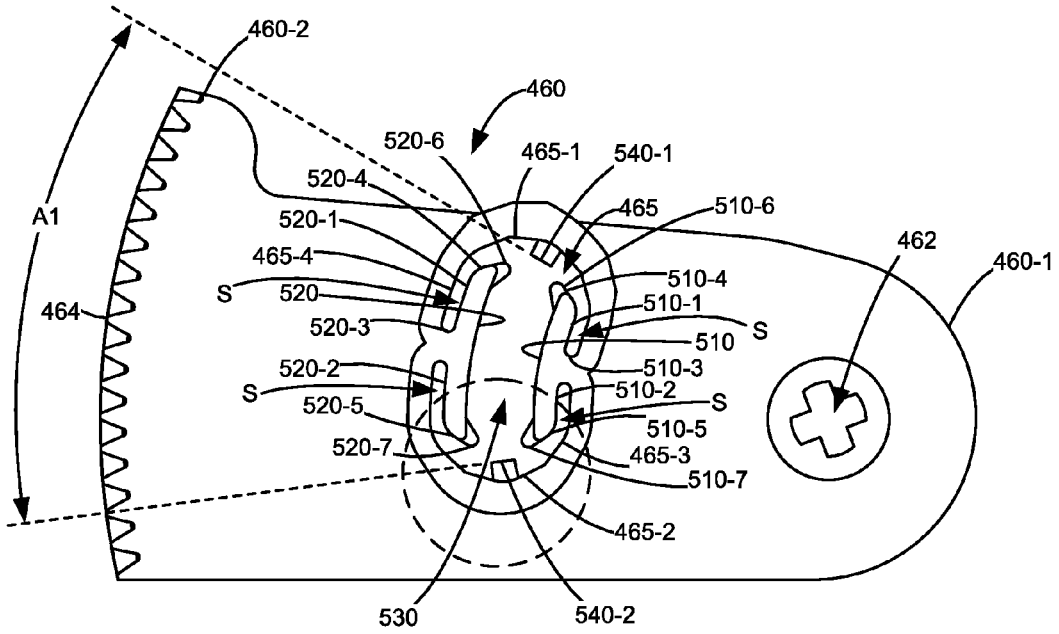
FIG. 6 illustrates noise dampeners used in the noise dampening sector gear of FIGS. 5A-5B.

As viewed in FIG. 6, dampeners 510, 520 have a squat T configuration. In one form cantilevered members 510-1, 510-2, 520-1, 520-2 may have a thickness of about 1.5 mm to about 2 mm. Dampeners 510, 520 are substantially parallel to each other with dampening fingers 510-6 and 520-6 being opposed to one another and dampening fingers 510-7 and 520-7 being similarly opposed. Dampeners 510, 520 and channel 530 are slightly curved to allow for the rotation of sector gear 460 about stop pin 500. Outer ends 510-4, 510-5 of dampener 510 and outer ends 520-4, 520-5 of dampener 520 are each spaced apart from the inner side walls 465-3, 465-4, respectively, of slot 465. The spacing S is sufficient to allow opposed fingers 510-6, 520-6 and opposed fingers 510-7, 520-7 to flex outwardly with respect to channel 530 when encountering the unthreaded portion 504 of stop pin 500 without hitting the respective inner side wall 465-3, 465-4 of slot 465. For example, this spacing may be between 1 to 2 mm.

Figure 7:
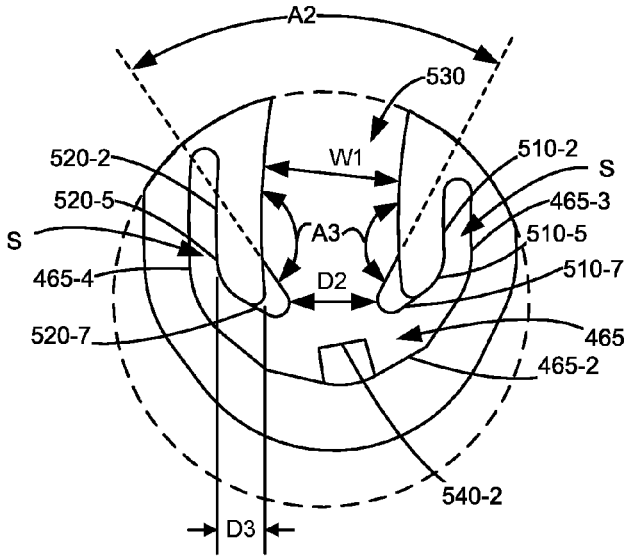
FIG. 7 is an enlarged view of one end of the noise dampeners of the sector gear of FIG. 6.

The tips of fingers 510-6, 520-6 and fingers 510-7, 520-7 are a predetermined distance D2 apart where distance D2 is less than width W1 of channel 530 and less than the diameter of the unthreaded portion 504 of stop pin 500. For example where W1 is about 6 mm and the diameter of stop pin 500 is 4 mm, distance D2 is about 3 mm to less than 4 mm. As shown in FIG. 7, opposed fingers 510-7, 520-7 form a predetermined angle A2 with respect to one another which, in one example form, may be about 60 to about 65 degrees. Stated differently, each finger is at an obtuse angle A3 of between about 120 degrees to about 123 degrees with respect to its cantilevered member or dampener. Opposed fingers 510-6, 520-6 are similarly angled with respect to one another. Slot 465 may have a width of about 12 mm to about 15 mm to accommodate dampeners 510, 520 and stop pin 500. The above dimensions are given by way of illustration and not limitation. The tips of fingers 510-6, 520-6 and fingers 510-7, 520-7 are rounded and aligned with one another so that they will engage with the stop pin at substantially the same time as the diverter gate 490 switches between its positions. The tips of fingers 510-6, 520-6 and fingers 510-7, 520-7 may be tapered as shown in FIG. 7.

Opposed stops 540-1, 540-2 may be provided depending inwardly from respective slot ends 465-1, 465-2. Stops 540-1, 540-2 may be provided in lieu of slot ends 465-1, 465-2 hitting stop pin 500 as the diverter gate 490 switches between positions.

Figure 8:
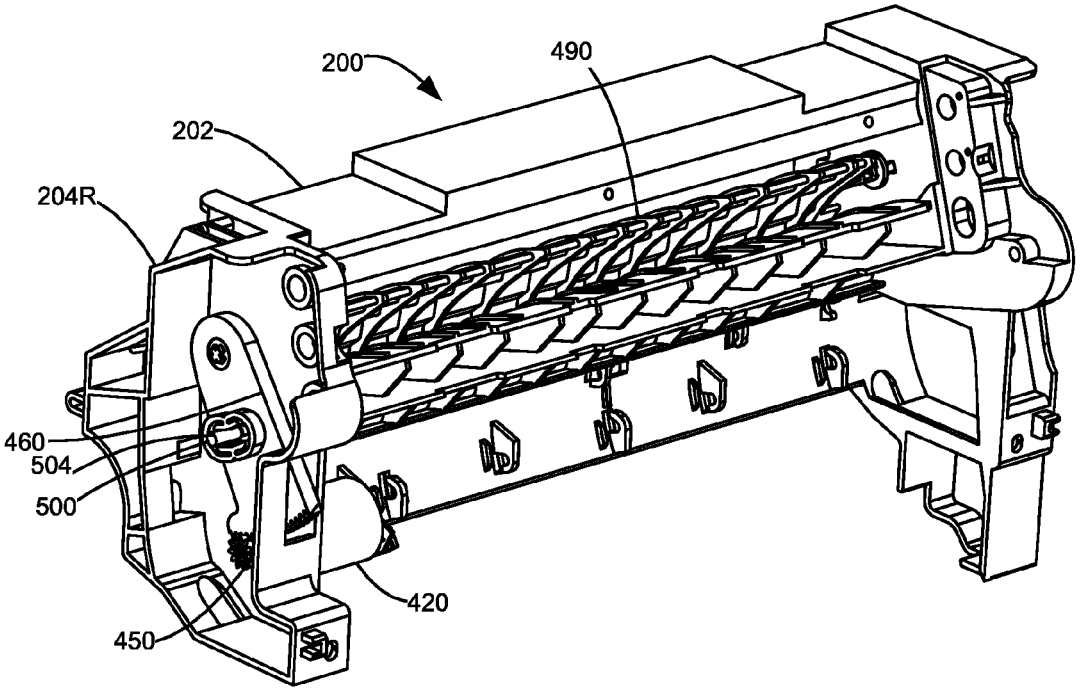
FIG. 8 illustrates the diverter gate of the re-drive assembly at a first position to direct a media sheet into a duplex path during a peek-a-boo duplexing operation.
Figure 9:
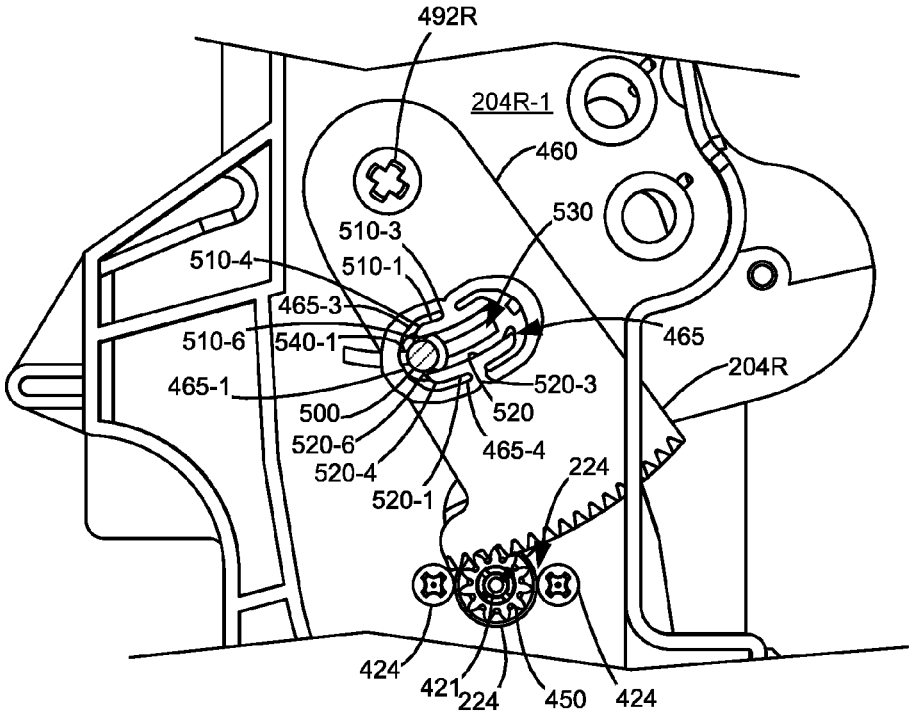
FIG. 9 illustrates the positioning of the sector gear of the re-drive assembly when the diverter gate is at its first position shown in FIG. 8.

Referring to FIGS. 8-11, operation of re-drive assembly 200 is illustrated. The head portion 502 of stop pin 500 has been removed to better see the interaction of stop pin 500 with dampening fingers 510-6, 520-6, and dampening fingers 510-7, 520-7. In FIG. 8, sector gear 460 and diverter gate 490 are driven by drive motor 420 in a first direction to respective first positions to direct a media sheet to the first nip 303. As shown in FIG. 9, stop pin 500 is in abutment with opposed stop 540-1 at slot end 465-1. Opposed dampening fingers 510-6, 520-6 are flexed by stop pin 500. Opposed dampening fingers 510-6, 520-6 encounter stop pin 500 shortly before stop 540-1 hits stop pin 500 as sector gear 460 is driven to its first position.

Figure 10:
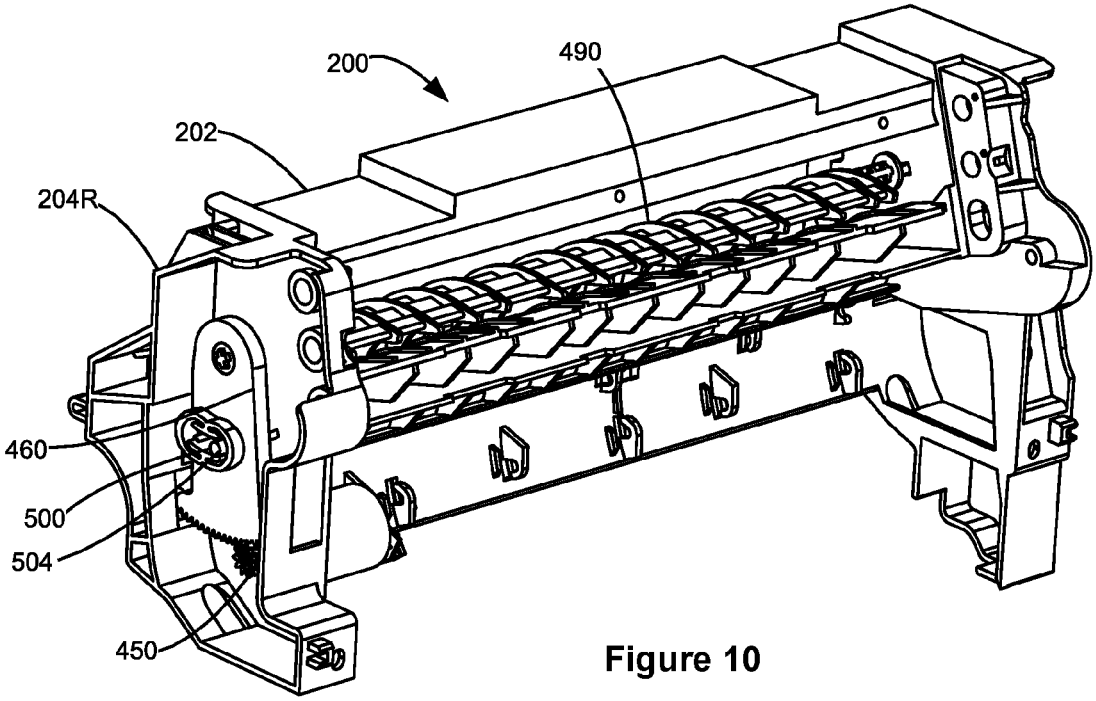
FIG. 10 illustrates the diverter gate of the re-drive assembly at a second position to direct a media sheet into a simplex path.
Figure 11:
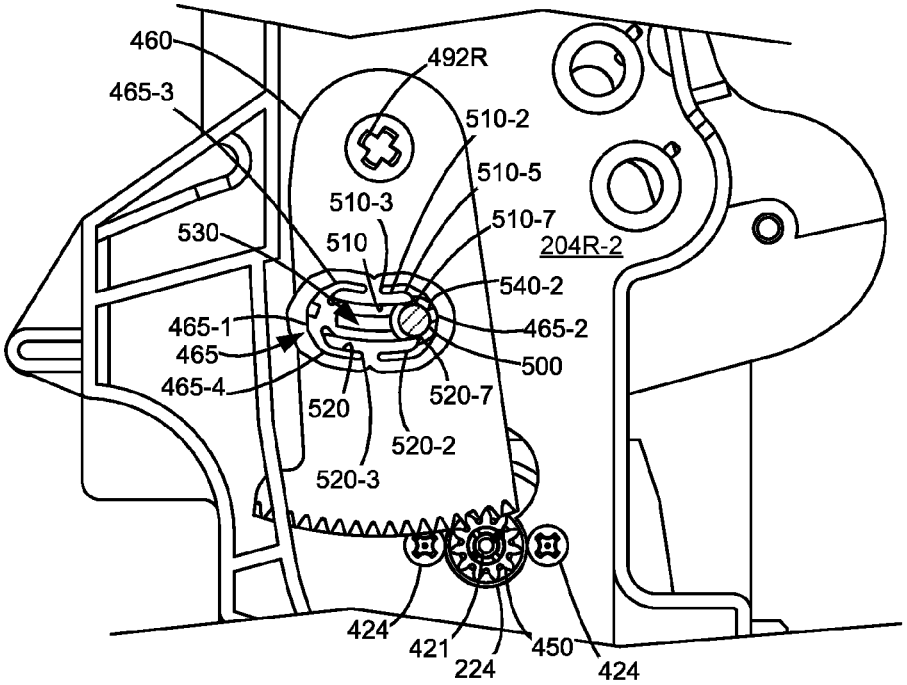
FIG. 11 illustrates the positioning of the sector gear of the re-drive assembly when the diverter gate is at its second position shown in FIG. 10.

In FIG. 10, drive motor 420 has been reversed and sector gear 460 and diverter gate 490 have been driven by drive motor 420 to their respective second positions where diverter gate 490 is positioned to direct a media to the second nip 305. As shown in FIG. 11, stop pin 500 is in abutment with opposed stop 540-2 at slot end 465-2. Opposed dampening fingers 510-7, 520-7 are flexed by stop pin 500. Opposed dampening fingers 510-7, 520-7 encounter stop pin 500 shortly before stop 540-2 hits stop pin 500.

In comparison testing done with a sector gear having only opposed stops 540-1, 540-2 in slot 465 and no dampeners, sector gear 460 having dampeners 510, 520 with the opposed pairs of flexible dampening fingers was on average about 20 dB quieter. The flexing of the opposed dampening fingers 510-6, 520-6 and 510-7, 520-7 acts to dissipate the impact energy of the sector gear 460 against the stop pin 500, greatly reducing the transient acoustic impulse that occurs when the diverter gate 490 switches positions and the sector gear strikes stop pin 500.

Figure 12:
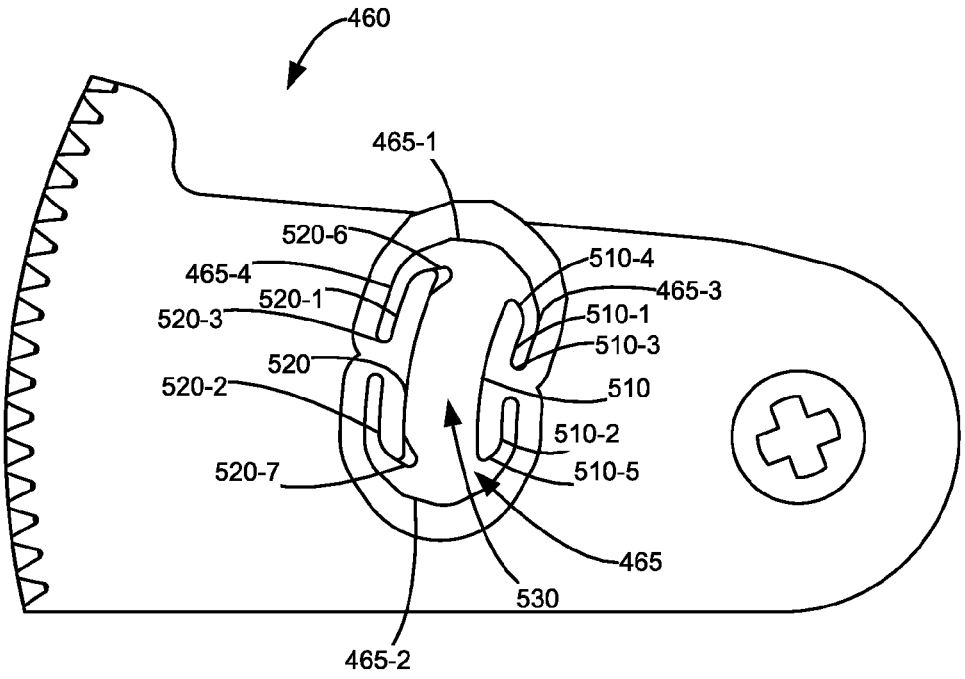
FIGS. 12-14 illustrate alternate embodiments of the noise dampeners used in the sector gear of the re-drive assembly.
Figure 13:
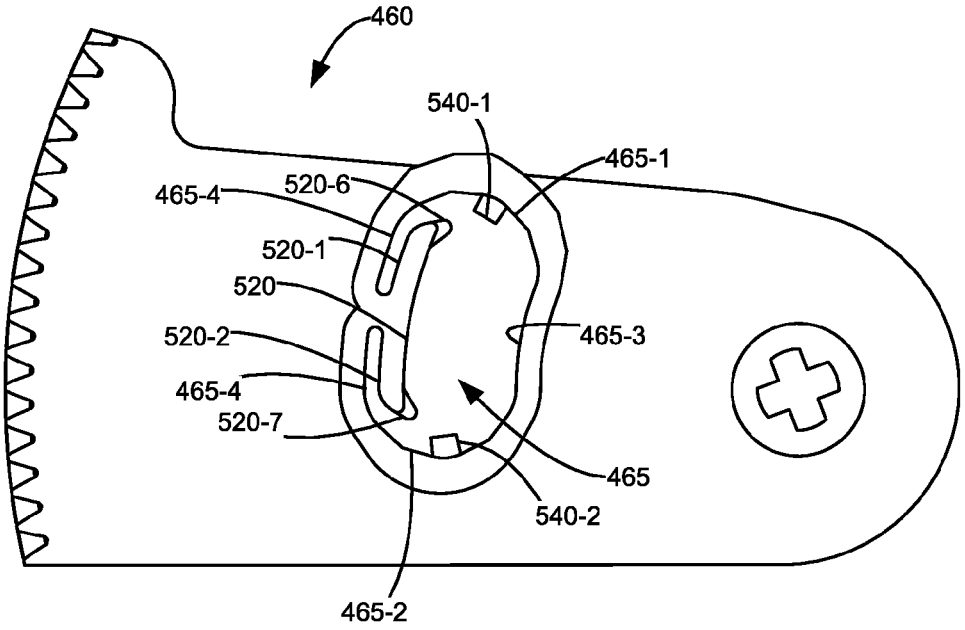
Figure 14:
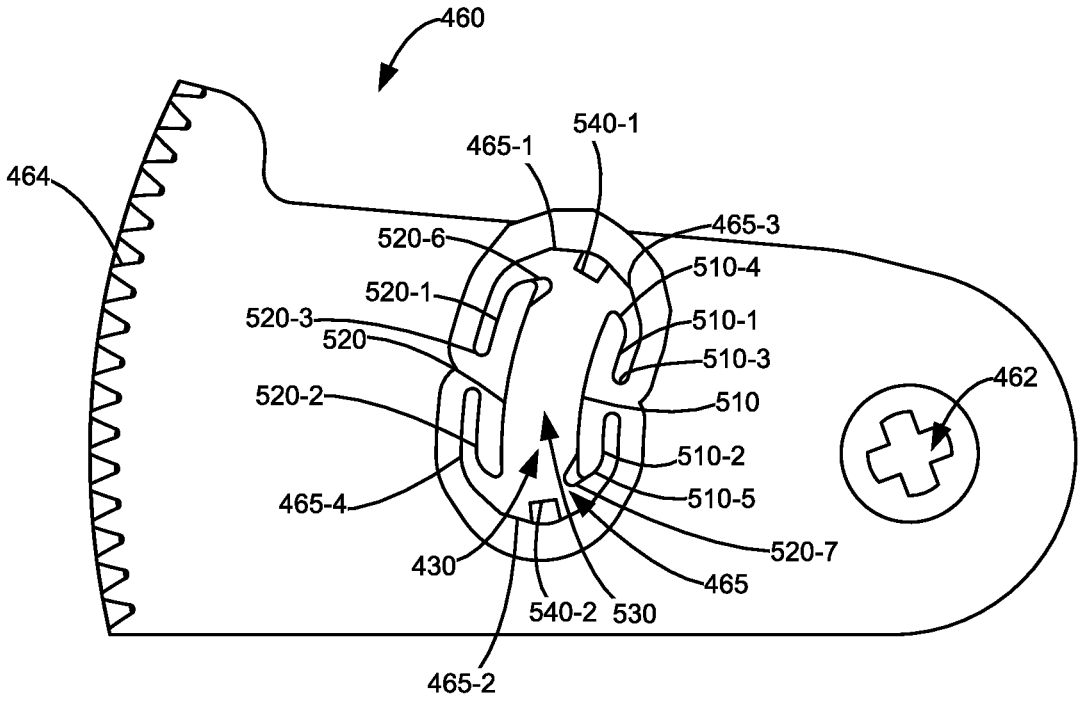

Alternate embodiments of the dampeners 510, 520 are shown in FIGS. 12-14. In FIG. 12, opposed stops 540-1, 540-2 have been removed from slot 465 of sector gear 460 and dampening fingers having been removed from one of the dampeners. As shown dampener 510 has no dampening fingers at the ends 510-4, 510-5 of members 510-1, 510-2, respectively, while dampener 520 mounted on inner side wall 465-4 retains its ends dampening fingers 520-6, 520-7 at the ends 520-4, 520-5 of members 520-1, 520-2, respectively. In FIG. 13 one of the dampeners has been removed from sector gear 460. As shown only dampener 520 is provided on inner side wall 465-4 in slot 465 of sector gear 460. Opposed stops 540-1, 540-2 are also provided. In FIG. 14, two dampeners 510, 520 have been provided along with opposed stops 540-1, 540-2. However, each of dampeners 510, 520 have been modified to provide only a single dampening finger on opposite ends. As shown dampening fingers 510-6, 520-7 have been removed from dampeners 510, 520, respectively leaving only a single dampening finger 510-7 and 520-6 on opposite ends the dampeners 510, 520 respectively. As would be understood by a person of skill in the art, the thickness and size of the dampeners and the dampening fingers is a matter of design choice. For example where only a single dampening finger is used on a dampener, such dampening finger may have a great thickness to better withstand the impact of the stop pin than when two dampening fingers are used.

Various combinations of dampeners, dampening fingers, and stops or no stops may be used. However at least one cantilevered dampening finger should be positioned at each end of slot 465 to encounter stop pin 450 before either the end of slot 465 or the stop provided thereat contacts the stop pin 450 as the diverter gate reaches it new position. Further, it will be recognized that while each dampener is shown having a single central mount and two free ends, two arms (L-shaped) each separately attached to the inner side wall of the slot may be used. The sector gear may be fabricated from polyoxymethylene also known as POM or other thermoplastics having similar properties as is known in the art.

It will be appreciated that the timing and movement of the media sheets is under the direction of the controller 108 and that depending on the overall length of the media path 112, more than one media sheet may be in the duplex path 118 or that simplex and duplex imaging operations can be interleaved with one another.

The foregoing description of embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A re-drive assembly for a media sheet in a media path of an imaging device, the media path having a simplex path and an duplex path with the re-drive assembly positioned between an exit of the simplex path and an entrance of the duplex path and an exit of the imaging device, the re-drive assembly comprising:

a frame having a left and a right side positioned on opposite sides of the media path;

a diverter gate pivotally mounted to the left and right sides of the frame, the diverter gate having a first position where the media sheet can be directed into the duplex path and a second position where the media sheet can be directed to the exit of the imaging device;

a reversible drive motor mounted to the frame and having a drive gear on an output shaft;

a sector gear having a first end fixedly mounted to an end of the diverter gate and a second end coupled to the drive gear, the sector gear when driven by the drive motor via the drive gear rotates the diverter gate between its first and second positions;

the sector gear having a slot therein positioned between the first and second ends of the sector gear, the slot having opposed inner side walls and opposed first and second ends;

at least one dampener depending from a first of the inner side walls into the slot, the dampener having two free ends spaced from the first inner side wall, each free end having a flexible dampening finger depending therefrom into the slot and spaced apart from an adjacent end of the slot; and, a stop pin mounted to the frame and in the slot, wherein, as the diverter gate is rotated from its first position to its second position, the stop pin engages with the dampening finger adjacent to the second end of the slot prior to the second end of the slot hitting the stop pin, and, as the diverter gate is rotated from its second position to its first position, the stop pin engages with the dampening finger adjacent to the first end of the slot prior to the first end of the slot hitting the stop pin.

2. The re-drive assembly of claim 1 wherein, a stop depends inwardly from each end of the slot.

3. The re-drive assembly of claim 1 wherein, each dampening finger is at an obtuse angle with respect to the at least one dampener.

4. The re-drive assembly of claim 3 wherein, each dampening finger forms an angle of about 120 to about 123 degrees with respect to the at least one dampener.

5. The re-drive assembly of claim 1 wherein, the opposed inner side walls are curved and the slot has an arcuate length of about 40 degrees between the opposed first and second ends of the slot.

6. The re-drive assembly of claim 1 wherein, the at least one dampener comprises a second dampener having a dampening finger depending from each free end thereof, the second dampener mounted in a mirror image arrangement with respect to the at least one dampener on a second of the opposed inner side walls.

7. A re-drive assembly for a media sheet in a media path of an imaging device, the media path having a simplex path and an duplex path with the re-drive assembly positioned between an exit of the simplex path and an entrance of the duplex path and an exit of the imaging device, the re-drive assembly comprising:

a frame having a left and a right side positioned on opposite sides of the media path;

a diverter gate pivotally mounted to the left and right sides of the frame, the diverter gate having a first position where the media sheet can be directed into the duplex path and a second position where the media sheet can be directed to the exit of the imaging device;

a reversible drive motor mounted to the frame and having a drive gear on an output shaft;

a sector gear having a first end fixedly mounted to an end of the diverter gate and a second end coupled to the drive gear, the sector gear when driven by the drive motor via the drive gear rotates the diverter gate between its first and second positions;

the sector gear having a slot therein positioned between the first and second ends of the sector gear, the slot having opposed inner side walls and opposed ends;

a first and a second dampener depending from a first and a second of the inner side walls, respectively, and into the slot forming a channel therebetween, each dampener having two free ends spaced from its respective inner side wall;

a first flexible dampening finger formed on one end of the first dampener and a second flexible dampening finger formed on the opposite end of the second dampener, the first and second dampening fingers depending into the channel and spaced apart from a first and a second end of the slot, respectively; and, a stop pin mounted to the frame and positioned within the channel, wherein, as the diverter gate is rotated from its first position to its second position, the stop pin engages with second dampening finger prior to the second end of the slot hitting the stop pin, and, as the diverter gate is rotated from its second position to its first position, the stop pin engages with the first dampening finger prior to the first end of the slot hitting the stop pin.

8. The re-drive assembly of claim 7 wherein, a stop depends inwardly from each end of the slot.

9. The re-drive assembly of claim 7 wherein, each dampening finger is at an obtuse angle with respect to the dampener from which it depends.

10. The re-drive assembly of claim 9 wherein, each dampening finger forms an angle of about 120 to about 123 degrees with respect to the dampener from which it depends.

11. The re-drive assembly of claim 7 wherein, the opposed inner side walls are curved and the slot has an arcuate length of about 40 degrees between the opposed first and second ends of the slot.

12. A re-drive assembly for a media sheet in a media path of an imaging device, the media path having a simplex path and an duplex path with the re-drive assembly positioned between an exit of the simplex path and an entrance of the duplex path and an exit of the imaging device, the re-drive assembly comprising:

a frame having a left and a right side positioned on opposite sides of the media path;

a two-position diverter gate pivotally mounted to the left and right sides of the frame;

a reversible drive motor mounted to the frame, a drive train including a helical drive gear mounted on an output shaft of the drive motor and a sector gear;

the sector gear having a first end fixedly mounted to an end of the diverter gate and a second end coupled to the drive gear, the sector gear when driven by the drive motor rotates the diverter gate between its two positions;

the sector gear having a slot therein positioned between the first and second ends of the sector gear, the slot having a first and a second opposed inner side wall and opposed ends;

a first and a second T-shaped dampener depending from the first and second inner side walls, respectively, forming a channel therebetween, a free end of each dampener positioned adjacent to a respective opposed end of the slot with each free end having a flexible dampening finger extending into the channel, with the second dampener mounted in a mirror image fashion with respect to the first dampener;

and, a stop pin mounted to the frame and in the channel, the stop pin having an unthreaded portion within the channel, wherein, as the diverter gate is rotated between its two positions and as one end of the slot nears the stop pin, the stop pin engages with the dampening fingers on the respective free ends of the first and the second dampeners prior to that end of the slot striking the stop pin.

13. The re-drive assembly of claim 12 wherein, a stop depends inwardly from each end of the slot.

14. The re-drive assembly of claim 12 wherein, each dampening finger is at an obtuse angle with respect to the dampener from which it depends.

15. The re-drive assembly of claim 14 wherein, each dampening finger forms an angle of about 120 to about 123 degrees with respect to the dampener from which it depends.

16. The re-drive assembly of claim 12 wherein, the opposed inner side walls are curved and the slot has an arcuate length of about 40 degrees between the opposed ends.

17. The re-drive assembly of claim 12 wherein, a width of the channel is about 6 mm, a diameter of the unthreaded portion of the stop pin is about 4 mm and a separation between ends of the dampening fingers on adjacent ends of the first and second dampeners is about 3 mm to less than 4 mm.

18. The re-drive assembly of claim 12 wherein, the sector gear is formed from a polyoxymethylene material.

* * * * *